United States Patent [19]

Nakase et al.

[11] 3,947,326

[45] Mar. 30, 1976

[54] VERTICAL TUBE TYPE CRACKING FURNACE

[75] Inventors: Noriaki Nakase, Nagano; Yoshiaki Nagamine, Osaka, both of Japan

[73] Assignee: Mitsui Shipbuilding & Engineering Co. Ltd., Tokyo, Japan

[22] Filed: Mar. 18, 1974

[21] Appl. No.: 451,924

[30] Foreign Application Priority Data

Mar. 22, 1973 Japan ..... 48-32850

[52] U.S. Cl. ..... 196/110; 196/116

[51] Int. Cl.[2] ..... B01D 1/00; C10G 1/02

[58] Field of Search ..... 196/116, 110; 122/356; 23/277 R, 288 M, 284

[56] References Cited

UNITED STATES PATENTS

| | | | |
|---|---|---|---|
| 2,598,840 | 6/1952 | Schutte | 196/110 |
| 2,964,033 | 12/1960 | Throckmorton et al. | 122/356 X |
| 3,172,739 | 3/1965 | Koniewiez | 23/288 M |
| 3,215,502 | 11/1965 | Korwin | 196/110 |
| 3,274,978 | 9/1966 | Palchik et al. | 122/356 |
| 3,361,538 | 1/1968 | Hess | 196/110 |
| 3,385,269 | 5/1968 | Breckenridge | 122/356 X |
| 3,512,506 | 5/1970 | Von Wiesenthal | 122/356 |

OTHER PUBLICATIONS

Heat Engineering, "Simplifed Vertical Heater", May--June 1949, Vol. XXIV, No. 3, pp. 45–47.

*Primary Examiner*—Jack Sofer

*Attorney, Agent, or Firm*—Howson and Howson

[57] ABSTRACT

Vertical tube type cracking furnace in which a convection-heating section for preheating the process fluid is provided above the combustion chamber, and gas passages connecting the convection-heating section and the combustion chamber are symmetrically provided.

3 Claims, 4 Drawing Figures

VERTICAL TUBE TYPE CRACKING FURNACE

This invention relates to a cracking furnace for ethylene and the like.

The object of this invention is to provide a vertical tube type cracking furnace in which heating of vertical tubes may be uniformly performed in the furnace.

Other objects of this invention will become apparent from the following description and accompanying drawings, in which.

Figure 1:
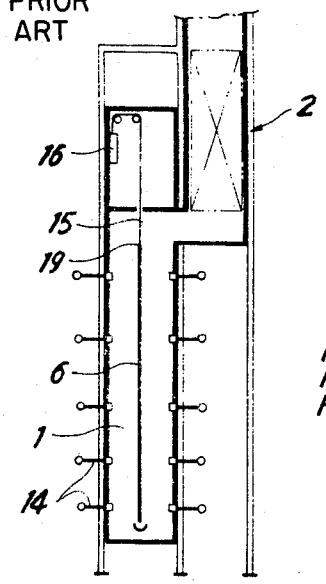
FIG.1 PRIOR ART
FIG. 1 is a sectional view of the conventional vertical type cracking furnace.

Referring to the drawings, FIG. 1 shows a conventional cracking furnace, in which each reaction tube 6 is suspended by a lifting rag 15 the other end of which suspends a weight 16, and said reaction tube 6 is heated by a plurality of burners 14 provided within the side wall of the combustion chamber 1. Combustion exhaust gas is introduced into a convection-heating section 2, which is arranged in staggered relation to the combustion chamber, where heat of the exhaust gas is recovered.

There are disadvantages in the conventional cracking furnace as follows.

(1) The flow of combustion gas from the combustion chamber 1 to the convection-heating section 2 is not uniform flow, and turbulent flow is generated between the combustion chamber and the convection-heating section 2, because of the unsymmetrical arrangement of the section 2. Thus it is difficult to obtain a uniform distribution of temperature and of gas flow of the combustion gas at the inlet of the section 2. Consequently, the temperature of fluid in each heating tube of the heating section 2 is different from the temperature of other heating tubes at the outlet thereof. The fluid of different temperature at every heating tubes is introduced in the corresponding reaction tube 6. Thus, it is difficult to control the temperature of the fluid in each reaction tube. Further, since the combustion gas flow is turbulent at the upper portion of the combustion chamber, it is difficult to regulate the gas temperature to a predetermined value.

(2) Since the combustion gas passes across the lifting rag 15, return bend 19 and upper portion of the reaction tube 6, these parts must be made of high quality heat-resisting metal.

(3) In the case that a number of ethylene cracking furnaces are installed, there is necessary a large site.

This invention is to remove the above described difficulties of the conventional cracking furnace.

Figure 2:
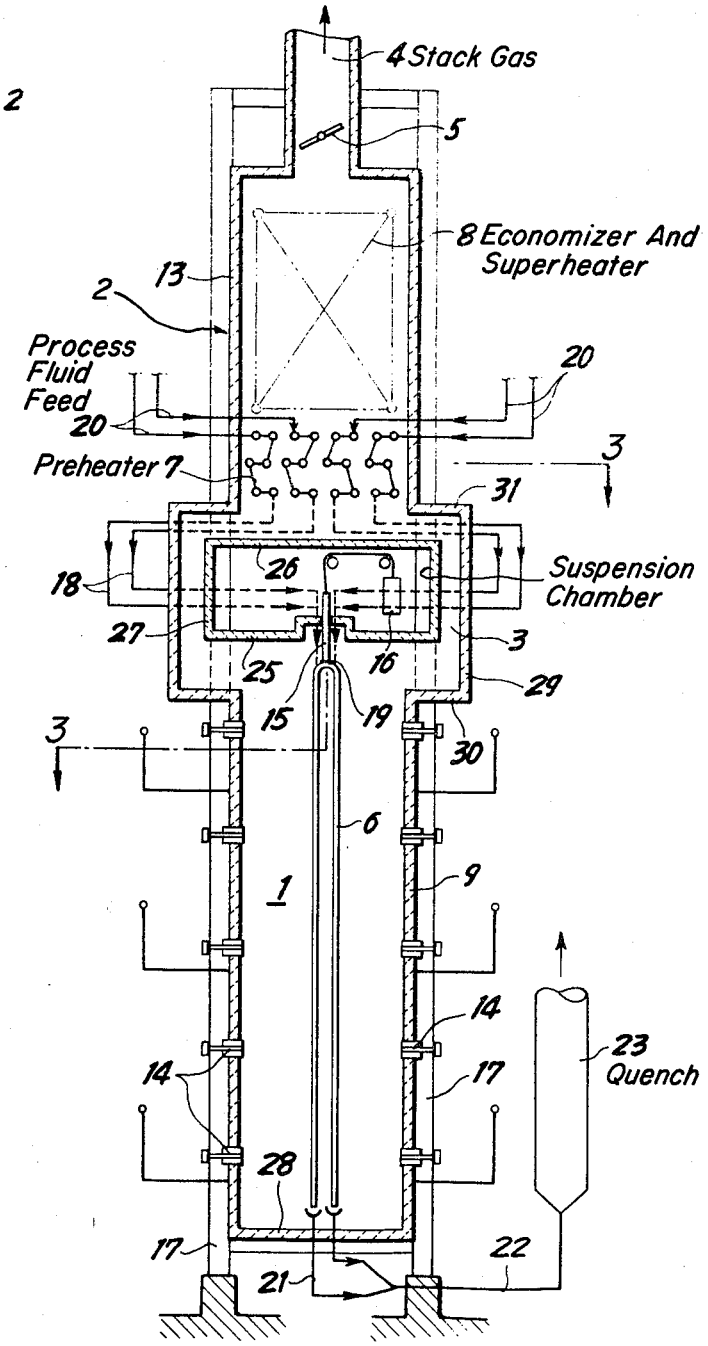
FIG. 2 is a sectional view of the vertical type cracking furnace of the present invention.
Figure 3:
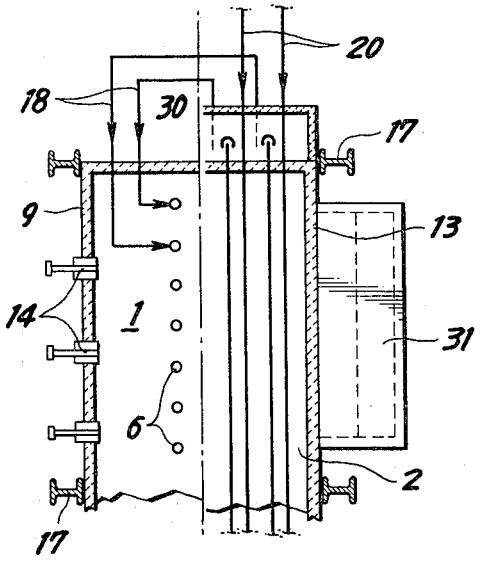
FIG. 3 is a sectional view taken along line 3—3 of FIG. 2.

Referring to FIGS. 2 and 3, the convection-heating section 2 is provided above the combustion chamber 1. The combustion chamber 1 has a rectangular shape in horizontal section and comprises side walls 9, ceiling 25, floor 28 and end walls 30, which are made of fire resisting material, and is constructed in a symmetrical structure by these components. A plurality of burners 14 are provided in the side walls 9 to heat reaction tubes 6 which are provided in one or two rows in the center of the cracking furnace. Each reaction tube 6 is suspended by the lifting rag 15 engaged with the return bend 19 and the weight 16, and the weight 16 and the connecting wire rope are provided in the space enclosed by heat resisting walls comprising ceiling 25, floor 26 of the convection-heating section 2 and walls 27. Outside the space, a pair of exhaust gas passages 3 are symmetrically formed by walls 30, 29, 31, 25, 27 and 26 in symmetry with respect to the plane including the row of tubes 6.

In the convection-heating section 2, a plurality of horizontal tubes 7 are divided in four groups and connected to each other at their ends by return bends in each group. In order to increase the heat efficiency of the cracking furnace, an economizer and steam superheater 8 is provided above the horizontal tube groups 7. Exhaust gas passed through the superheater 8 passes through the damper 5 and duct 4 and is exhausted to the atmosphere. The cracking furnace constructed in the above composition is supported by frame 17.

Process fluid is introduced in the convection-heating section 2 by pipings 20 at every group of the horizontal tubes 7 for preheating of the fluid. The preheated fluid is introduced in reaction tubes 6 by passing through crossover pipings 18. The fluid is cracked in the reaction tubes 6 and reaction products are fed to the quencher 23 by passing through the outlet pipings 21 and collecting pipings 22.

Figure 4:
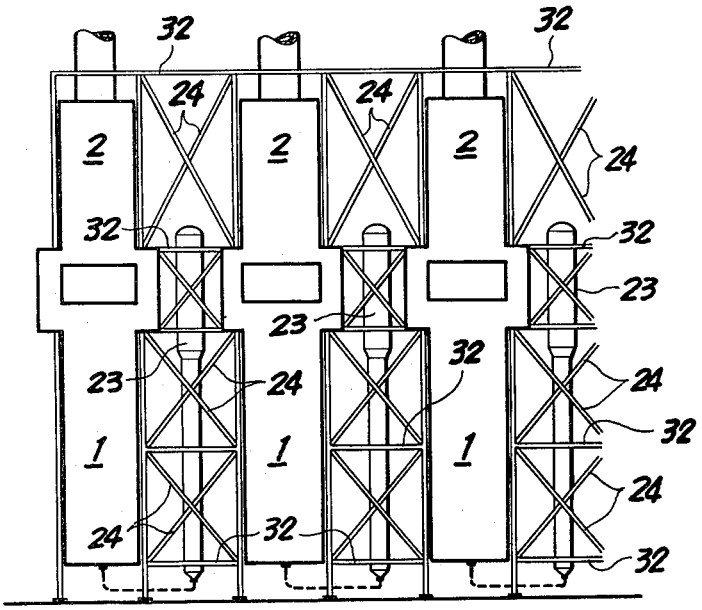
FIG. 4 shows an arrangement of a large number of cracking furnaces.

In the case that a number of cracking furnaces are installed, quenchers 23 are provided between furnaces as shown in FIG. 4 and all furnaces are supported by the framework comprising supports 17, beams 32 and bracing 24.

Since the combustion gas uniformly and symmetrically flows in the combustion chamber 1 and passes through convection-heating section 2 without the turbulent flow, it is easy to control the outlet temperature of the process fluid in the convection-heating section to maintain it at a predetermined value. As a result, temperature of the process fluid in reaction tubes may be maintained constant.

The combustion gas does not flow across the reaction tubes, return bends and lifting rags. In addition these parts are positioned at a lower temperature point in the furnace. Accordingly, the furnace is constructed in a suitable structure to ensure the heat resistance.

Since the furnace is symmetrically constructed, the frame 7 is uniformly expanded by heat of combustion. Therefore, it is not necessary to consider the thermal stress on the supports, beams and the like upon the design of the frame. Further, in the case of a larger number of furnaces, the furnaces and quenchers may be assembled in the simple structure and small size, because of the symmetrical construction.

I claim:

1. A vertical tube type cracking furnace for cracking a process fluid, comprising:

a combustion chamber;

a plurality of vertical reaction tubes suspended in a straight row along a central portion of said combustion chamber;

burner means on opposite side walls of said combustion chamber for heating said reaction tubes in said combustion chamber;

heat-resistant walls defining a suspension chamber above said combustion chamber isolated from the combustion gases;

suspension means in said suspension chamber for suspending said reaction tubes;

a convection-heating chamber means positioned above said suspension chamber for pre-heating said process fluid;

fluid connection means extending from said convection-heating chamber means to said reaction tubes; and exhaust gas passage ways surrounding said suspension chamber on at least two sides thereof and connecting said combustion chamber to said convection-heating chamber means, said gas passage ways being substantially symmetrical, a vertical plane extending through said row of tubes and with respect to said combustion chamber and said convection chamber means, whereby exhaust gas flows serially therethrough without passing laterally across said tubes and suspension means.

2. The furnace of claim 1, in which said combustion chamber, said suspension chamber and said convection-heating chamber means are disposed one directly above the other in the last-stated order and symmetrically about said plane.

3. The furnace of claim 1, in which said heat-resistant walls of said suspension chamber provide at least one wall of said gas passages.

* * * * *